US006250102B1

(12) United States Patent
Tischer

(10) Patent No.: US 6,250,102 B1
(45) Date of Patent: Jun. 26, 2001

(54) OIL AND REFRIGERANT PUMP FOR CENTRIFUGAL CHILLER

(75) Inventor: James C. Tischer, La Crescent, MN (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/570,303

(22) Filed: May 12, 2000

Related U.S. Application Data

(62) Division of application No. 09/206,198, filed on Dec. 3, 1998, now Pat. No. 6,098,422.

(51) Int. Cl.[7] ..... F25B 31/00
(52) U.S. Cl. ..... 62/505; 62/468; 62/84
(58) Field of Search ..... 62/505, 468, 84

(56) References Cited

U.S. PATENT DOCUMENTS

| | | | | |
|---|---|---|---|---|
| 2,814,254 | * | 11/1957 | Litzenberg | 103/87 |
| 2,830,755 | * | 4/1958 | Anderson | 230/132 |
| 3,149,478 | * | 9/1964 | Anderson et al. | 62/469 |
| 3,183,838 | * | 5/1965 | Englesson | 103/4 |
| 3,195,468 | * | 7/1965 | Bood | 103/87 |
| 3,203,352 | * | 8/1965 | Schafranek | 62/87 |
| 3,389,569 | * | 6/1968 | Endress | 62/84 |
| 3,606,581 | * | 9/1971 | Sjotun | 417/45 |
| 3,645,112 | * | 2/1972 | Mount et al. | 62/505 |
| 3,838,581 | * | 10/1974 | Endress | 62/468 |
| 4,399,663 | * | 8/1983 | Hesler | 62/193 |
| 4,404,812 | * | 9/1983 | Zinsmeyer | 62/84 |
| 4,419,865 | * | 12/1983 | Szymaszek | 62/193 |
| 4,995,792 | * | 2/1991 | Brown et al. | 417/366 |
| 5,182,919 | * | 2/1993 | Fujiwara | 62/193 |
| 5,499,509 | * | 3/1996 | Harold et al. | 62/117 |
| 5,675,978 | * | 10/1997 | Hamm, Jr. et al. | 62/84 |
| 5,848,538 | * | 12/1998 | Tischer | 62/468 |
| 5,987,914 | * | 11/1999 | Sumida et al. | 62/468 |
| 6,009,722 | * | 1/2000 | Choi et al. | 62/505 |
| 6,018,962 | * | 2/2000 | Dewhirst et al. | 62/468 |
| 6,098,422 | * | 8/2000 | Tischer | 62/505 |

* cited by examiner

*Primary Examiner*—William Doerrler
*Assistant Examiner*—Mark Shulman
(74) *Attorney, Agent, or Firm*—William J. Beres; William O'Driscoll; Peter D. Ferguson

(57) ABSTRACT

In a preferred embodiment, a single motor drives both oil and refrigerant pumps in a refrigeration chiller, the motor and oil pump being disposed in the chiller's oil supply tank and the refrigerant pump being disposed exterior thereof. The refrigerant pump pumps liquid refrigerant to the chiller's compressor section so as to cool the motor by which the compressor is driven while the oil pump pumps oil to chiller locations that require lubrication when the chiller is in operation. A uniquely designed impeller permits low pressure liquid refrigerant in its liquid state to be reliably pumped to a location of use, without significant flashing, from a source location which is at a height only a short distance above the pump inlet. A stand alone refrigerant pump embodiment is also described.

14 Claims, 4 Drawing Sheets

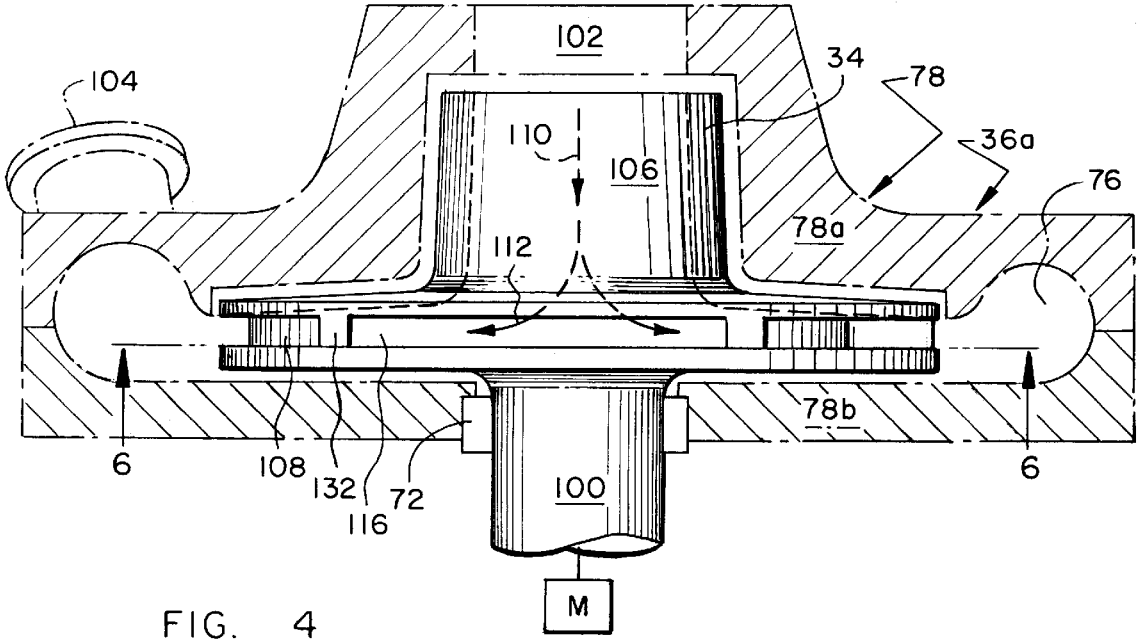
FIG. 4
FIG. 5
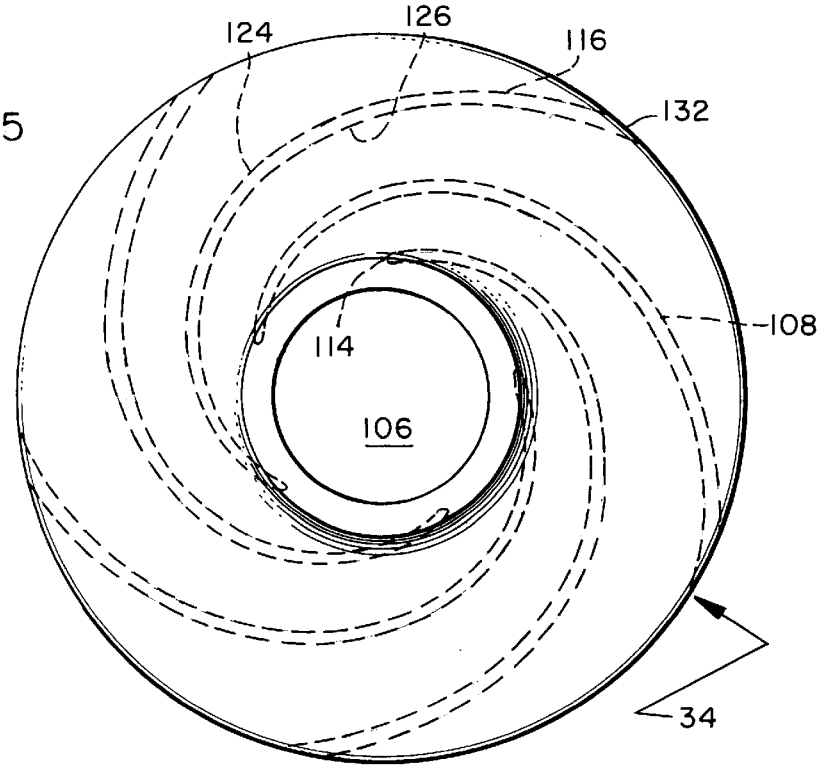

OIL AND REFRIGERANT PUMP FOR CENTRIFUGAL CHILLER

This application is a Division of U.S. Ser. No. 09/206,198 filed Dec. 3, 1998, now U.S. Pat. No. 6,098,422.

BACKGROUND OF THE INVENTION

The present invention relates to allowed U.S. patent application Ser. No. 08/965,495, to the lubrication of surfaces that require lubrication in a refrigeration chiller when the chiller is in operation and/or to the cooling, by system refrigerant, of the motor by which the compressor of such a chiller is driven. In its preferred embodiment, the present invention relates to combined oil and refrigerant pump apparatus that ensures the delivery, under all operating conditions, of both lubricant and liquid refrigerant to the locations at which they are needed in a refrigeration chiller that employs a low pressure refrigerant.

Refrigeration chiller components include a compressor, a condenser, a metering device and an evaporator, the compressor compressing a refrigerant gas and delivering it, at relatively high pressure and temperature, to the chiller's condenser. The relatively high pressure, gaseous refrigerant delivered to the condenser rejects much of its heat content and condenses to liquid form in a heat exchange relationship with a heat exchange medium flowing therethrough.

Condensed, cooled liquid refrigerant next passes from the condenser to and through the metering device which reduces the pressure of the refrigerant and further cools it by a process of expansion. Such relatively cool refrigerant is then delivered to the system evaporator where it is heated and vaporizes in a heat exchange relationship with a liquid, such as water, flowing therethrough. The vaporized refrigerant then returns to the compressor and the liquid which has been cooled or "chilled" in the evaporator flows to a heat load in a building or in an industrial process application that requires cooling.

The compressor portion of a chiller typically includes both a compressor and a motor by which the compressor is driven. Such motors, in most if not all chiller applications, require cooling in operation and have often, in the past, been cooled by system refrigerant. In many chiller designs, gaseous refrigerant has been sourced upstream or downstream of the compressor for such purposes. In other designs, compressor drive motors have been cooled by liquid refrigerant sourced from a location within the chiller.

Chiller compressor drive motor cooling arrangements and chiller lubrication systems have, historically, been discrete from each other. In many cases, however, operation of the systems by which lubricant and motor cooling fluid were delivered to the locations of their use was predicated on the existence of a sufficiently high differential pressure within the chiller by which to drive oil or refrigerant from a relatively higher pressure source location to the relatively lower pressure location of their use in the chiller for such purposes.

The chemical constituencies and operating characteristics of refrigerants used in chillers have changed over the years, primarily as a result of environmental considerations, and the use of so-called "low pressure" refrigerants, such as HCFC 123, has become common in the past decade. These refrigerants are such that under certain chiller operating conditions the temperature and pressure existing in the system condenser approach those existing in the evaporator. As such, a sufficiently high pressure differential between the system evaporator and system condenser cannot be counted upon to exist under all chiller operating conditions to ensure the continuous availability of a pressure that can reliably be used to drive oil from the chiller's oil supply tank to chiller surfaces that require lubrication. Nor can such a reliably high pressure differential be counted upon to exist to ensure the delivery of refrigerant from a first chiller location to the motor which drives the system's compressor for purposes of cooling that motor. Both, once again, were common past practices that were permitted by the use of "higher pressure" refrigerants than are used today. In some applications, such practices continue to be in use today.

In view of the above-described circumstances, the present invention seeks, in its preferred embodiment, to advantageously incorporate aspects of both the lubrication system and motor cooling system in a refrigeration chiller in which a low pressure refrigerant is used to ensure, under all chiller operating conditions, the delivery of lubricant and refrigerant to the locations of their use for lubrication and motor cooling purposes. A second embodiment, relating to the pumping of liquid refrigerant independent of any relationship with the pumping of oil, is also described.

SUMMARY OF THE INVENTION

It is an object of the present invention to provide for lubrication and compressor drive motor cooling in a refrigeration chiller.

It is another object of the present invention to provide for the delivery of oil and liquid refrigerant to the locations of their use within a refrigeration system by the use of apparatus common to both purposes.

It is still another object of the present invention to provide apparatus for pumping both lubricant and liquid refrigerant in a refrigeration chiller which is unaffected by chiller operating conditions.

It is another object of the present invention to provide a pump for pumping low pressure liquid refrigerant in a manner which minimizes the pressure drop experienced thereby in the pumping process so as (1) to prevent any significant portion of the refrigerant from changing state to the gas phase as a result of the pumping process and (2) to avoid a significant loss in pump performance therefrom.

It is another object of the present invention to provide a pump for pumping liquid refrigerant in a refrigeration chiller that delivers pressure and flow over the entirety of a defined range of liquid refrigerant temperatures/pressures, which is suitable for both 60 Hertz and 50 Hertz application and which functions over a range of motor cooling flow rates sufficient to permit such pump to be used in the cooling of the drive motors of a family of chillers having a wide range of different capacities.

It is a further object of the present invention to provide the means by which to deliver both oil for lubrication purposes and liquid refrigerant for compressor drive motor cooling purposes by the use of liquid refrigerant and lubricant pumping apparatus which is driven by a single motor and drive shaft in a refrigeration chiller that employs a low pressure refrigerant.

These and other objects of the present invention, which will be appreciated by reference to the attached drawing figures and the following Description of the Preferred Embodiment, are accomplished by combined refrigerant/lubricant pump apparatus in a refrigeration chiller, the pumps being driven by a common drive shaft which is driven by a single electric motor disposed, along with the lubricant pump, in the chiller's oil supply tank. The use of electric motor driven pumps by which to deliver oil and liquid refrigerant for lubrication and compressor drive motor cooling purposes assures the continuous availability of both lubricant and liquid refrigerant for those purposes irrespective of the conditions under which the chiller operates.

The refrigerant pumping mechanism is preferably driven by the same drive shaft as the lubricant pump but is disposed exterior of the oil supply tank in which the motor and lubricant pump are disposed. By the integral mounting of both the refrigerant pump and lubricant pump to a single drive shaft driven by a single electric motor, the lubrication and compressor drive motor cooling functions are reliably carried out in a low pressure refrigerant environment by apparatus which employs a minimum number of parts and is of relatively low cost. The advantages and characteristics of the refrigerant pump make it separately useable and applicable in circumstances/applications where a stand alone liquid refrigerant pump is useful and/or required.

DESCRIPTION OF THE DRAWING FIGURES

FIG. 4 is a side view of the impeller of the refrigerant pump of the present invention shown ensconced in its housing.

FIG. 5 is an end view of the impeller of the refrigerant pump of the present invention.

DESCRIPTION OF THE PREFERRED EMBODIMENT

Figure 1A:
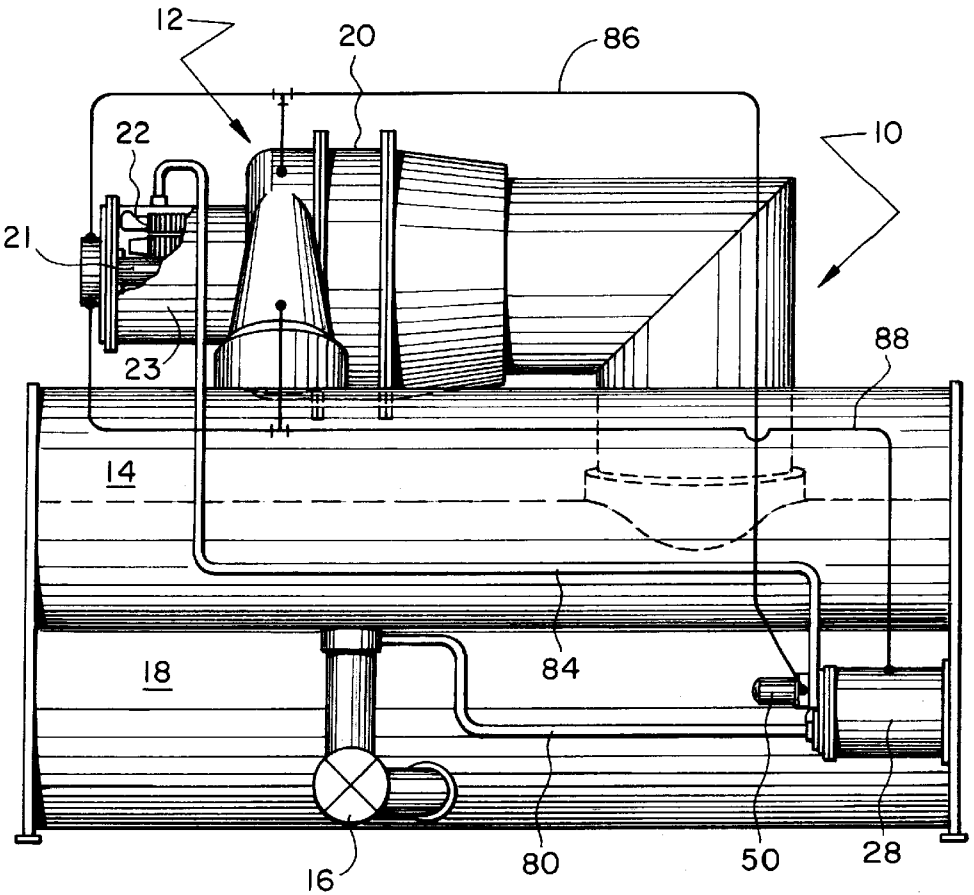
FIGS. 1A and 1B are side and end views of a refrigeration chiller in which the primary component parts thereof are illustrated.
Figure 1B:
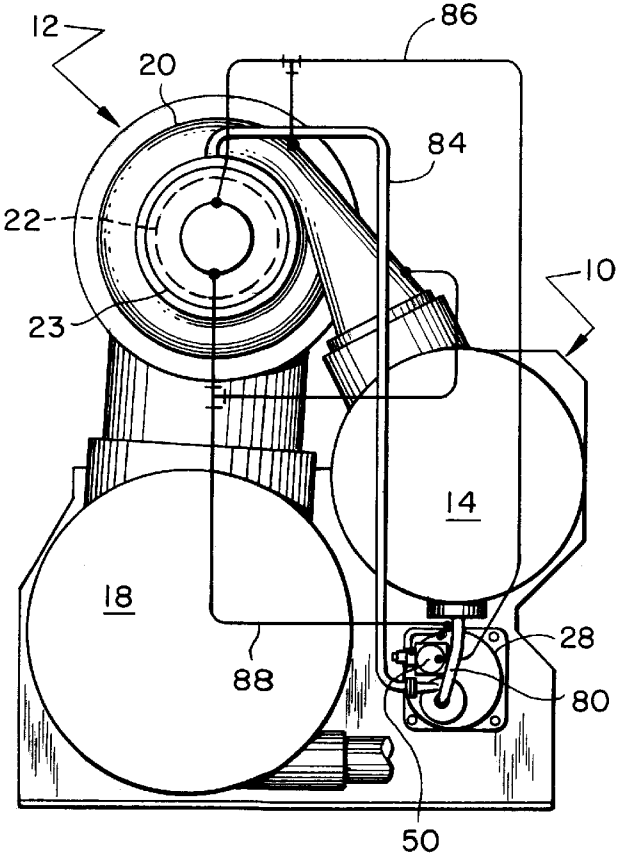

Referring initially to FIGS. 1A and 1B, the major components of refrigeration chiller 10 are a compressor portion 12, a condenser 14, a metering device 16 and an evaporator 18. Compressor portion 12 of chiller 10 is comprised of a centrifugal compressor 20 which is driven, through a drive shaft 21, by an electric motor 22 which is encased in a motor housing 23.

In operation, the driving of centrifugal compressor 20 by compressor drive motor 22 causes a relatively low pressure refrigerant gas, such as the refrigerant commonly know as HCFC 123, to be drawn from evaporator 18 into the compressor. By a process of centrifugal compression, the gas drawn from evaporator 18 is compressed and discharged from centrifugal compressor 20, in a heated, relatively high pressure state, to condenser 14.

The relatively high pressure, high temperature refrigerant gas delivered to condenser 14 transfers heat to a cooling medium, such as water, flowing therethrough. The heat exchange medium, if water, is typically sourced from a municipal water supply or a cooling tower. The refrigerant condenses in the course of rejecting its heat content to the cooling medium and next flows to metering device 16. Device 16 further reduces the pressure and temperature of the condensed refrigerant by a process of expansion.

The now relatively cool, relatively low pressure refrigerant, which is in two-phase but primarily liquid form after passage through the expansion device, next flows to evaporator 18 where it undergoes heat exchange with a fluid flowing therethrough, most typically, once again, water. In this heat exchange process, the relatively more warm fluid flowing through the evaporator rejects its heat content to the relatively cooler liquid refrigerant causing the refrigerant to vaporize. The now cooled or "chilled" fluid then flows from the evaporator to a location, such as a space in a building or a location in an industrial process, where chilled water is used for cooling purposes. The heated, now vaporized, relatively low pressure refrigerant is drawn back into compressor 20 to start the process anew.

In refrigeration chillers that employ certain so-called low pressure refrigerants, the pressure differential between the chiller evaporator and the chiller condenser is not as high, under all chiller operating conditions, as was the case in earlier chillers in which relatively higher pressure refrigerants were used. It is to be noted that some of these relatively higher pressure refrigerants, such as CFC 11, were themselves considered to be low pressure refrigerants during the period of their use.

Where such relatively higher pressure refrigerants were previously used, a relatively large pressure differential between the evaporator and condenser of a chiller could be counted upon to develop and continue to exist under all chiller operating conditions. In some chiller designs, particularly those employing a screw rather than centrifugal compressor, that made it convenient to use that differential pressure for purposes such as driving lubricant from the chiller's oil supply tank to lower pressure chiller locations requiring lubrication and/or to drive liquid refrigerant from a first location in the chiller to the lower pressure location of the chiller's compressor drive motor for drive motor cooling purposes.

Figure 2:
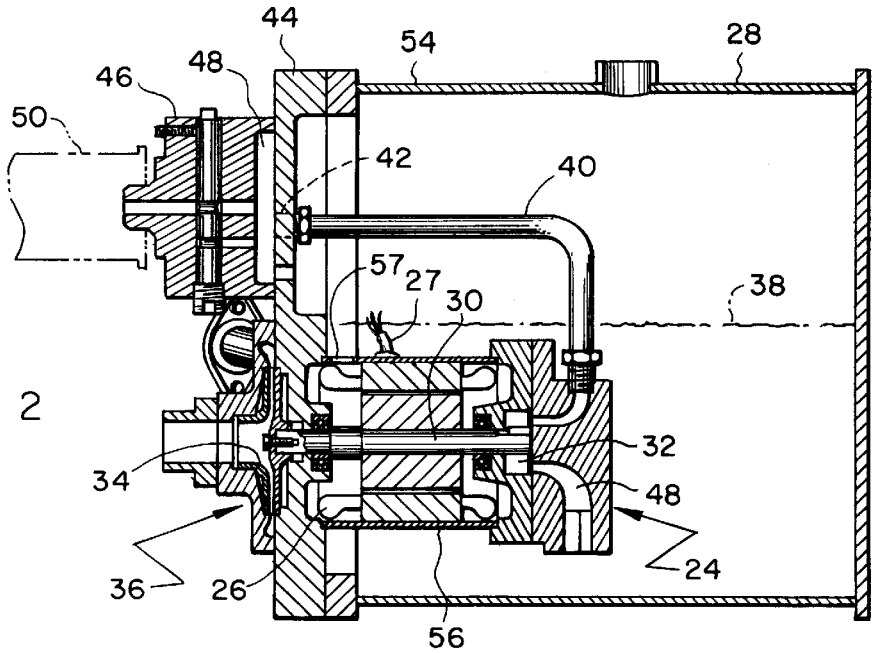
FIG. 2 is a cross-sectional view of the combined lubricant and refrigerant pumping apparatus of the present invention as installed within the oil supply tank of the chiller illustrated in FIGS. 1A and 1B.
Figure 3:
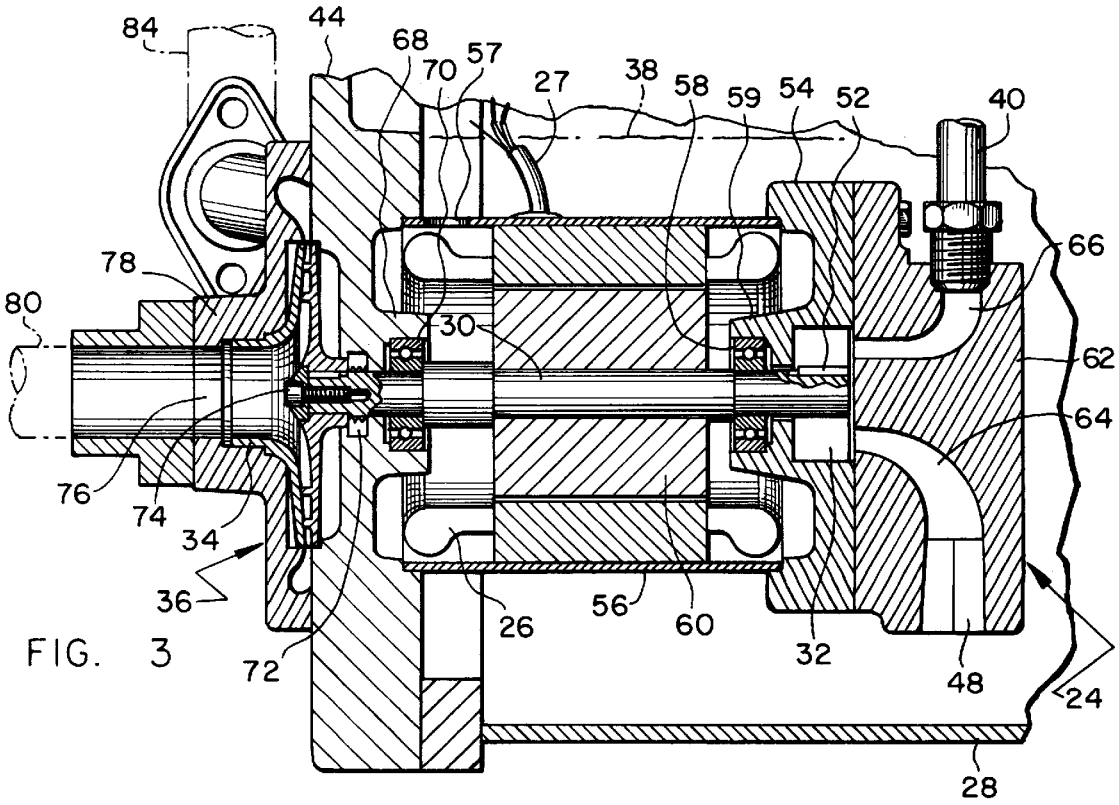
FIG. 3 is an enlarged view of the lubricant/refrigerant pumping apparatus portion of FIG. 2.

Referring additionally now to FIGS. 2 and 3, lubricant pump 24, in the chiller of the present invention, and electric motor 26 which drives it are disposed in the chiller's oil supply tank 28. Motor 26, to which power is delivered through electrical leads 27, drives a shaft 30 which, in turn, drives lubricant pumping element 32. Shaft 30 is likewise coupled to impeller 34 which is the pumping element of centrifugal refrigerant pump 36 and is mounted exterior of oil supply tank 28.

Lubricant is pumped by pump 24 through a pipe 40 disposed internal of oil supply tank 28 that communicates between lubricant pump 24 and an aperture 42 in the head wall 44 of the oil supply tank. A lubricant manifold 46, such as the one which is the subject of U.S. Pat. No. 5,675,978, assigned to the assignee of the present invention, is mounted to oil supply tank head wall 44 and has an intake chamber 48 into which lubricant is pumped by the operation of lubricant pump 24.

Lubricant manifold 46 is positionable to accomplish various lubrication related functions within the chiller, such as providing a set-up for the normal flow of lubricant to chiller bearings and surfaces, a set-up allowing for the change of the chiller oil supply while isolating the chiller's refrigerant charge, a set-up to allow the sampling of the chiller's oil supply for chemical analysis purposes and a set-up allowing for the change of oil filter 50 while isolating the chiller's oil supply. Among the bearings and surfaces to which lubricant must be provided in chiller 10 are the bearings which rotatably support the drive shaft 21 which connects compressor drive motor 22 and centrifugal compressor 20.

Referring primarily now to FIG. 3, it will be seen that in the preferred embodiment of the present invention lubricant pump element 32 is secured by key 52 to shaft 30 for rotation therewith and is disposed in lubricant pump element housing 54. Lubricant pump element housing 54 is attached to and supported by motor housing 56 which is, in turn, connected to and supported by head wall 44 of oil supply tank 28. It is to be noted that disposal of pump motor 26 in oil supply tank 28 brings with it the advantage of its being able to reject the heat it develops in operation to the oil which surrounds it. Motor 26 is, in fact, flooded with oil which is admitted into motor housing 56 through an aperture 57 therein.

Lubricant pump element housing 54 also houses bearing 58 in a bearing housing 59 integrally defined by it. Bearing 58 rotatably supports shaft 30 and rotor 60 of motor 26 at a first end. Lubricant pump port plate 62 is attached to and supported by lubricant pump element housing 54 and defines the flow path 64 by which oil is delivered from the interior of supply tank 28 to oil pump element 32 and the flow path 66 by which oil is delivered from oil pump element 32 to pipe 40.

Motor housing 56, as noted above, is mounted at its opposite end to oil supply tank head wall 44. Head wall 44, in the preferred embodiment, integrally defines a bearing housing 68 in which bearing 70 is disposed. Bearing 70 rotatably supports drive shaft 30 and motor rotor 60 at the ends thereof which are opposite the ends on which they are supported by bearing 58. Shaft 30 extends through and past bearing 70 and penetrates oil supply tank head wall 44. A portion of shaft 30 is surrounded by a seal 72 ensconced in oil supply tank head wall 44.

Refrigerant pumping impeller 34 is connected to shaft 30 for rotation therewith by a screw 74 which threads into an end face of shaft 30. Impeller 34 is disposed in impeller cavity 76 which is defined in volute housing 78. Volute housing 78 is mounted to the exterior surface of oil supply tank head wall 44. Seal 72 acts as a seal between impeller cavity 76 through which liquid refrigerant flows and the interior of oil supply tank 28. Because refrigerant pump 36 is of a centrifugal type it does not employ contacting parts, such as gear or other types of positive displacement pumps might and, as such, needs no lubrication.

Referring once again to all of Drawing FIGS. 1A, 1B, 2 and 3, refrigerant pump impeller cavity 76 is in flow communication on an intake side with condenser 14 of chiller 10 via intake piping 80 and is likewise in flow communication with the interior of compressor drive motor housing 23 via discharge piping 84. By the operation of pump motor 26, both lubricant pumping element 32 and refrigerant pumping impeller 34 are driven. As a result, lubricant is pumped out of oil supply tank 28, through piping 40, lubricant manifold 46 and lubricant piping 86 to various locations within chiller 10 that require lubrication, such lubricant being returned to supply tank 28 via return piping 88.

Simultaneously and by operation of the same apparatus, liquid refrigerant is pumped from chiller condenser 14 into the interior of compressor drive motor housing 23 where it is delivered into heat exchange contact with compressor drive motor 22 so as to cool that motor By the combined driving of both a liquid refrigerant pump and a oil pump by a single motor on a single drive shaft, the delivery of liquid refrigerant for compressor drive motor cooling purposes and the delivery of oil for lubrication purposes is reliably accomplished under all operating conditions within centrifugal chiller 10, which employs a low pressure refrigerant, all in a manner which reduces the number of parts associated with those functions as well as the costs involved in doing so.

Figure 6:
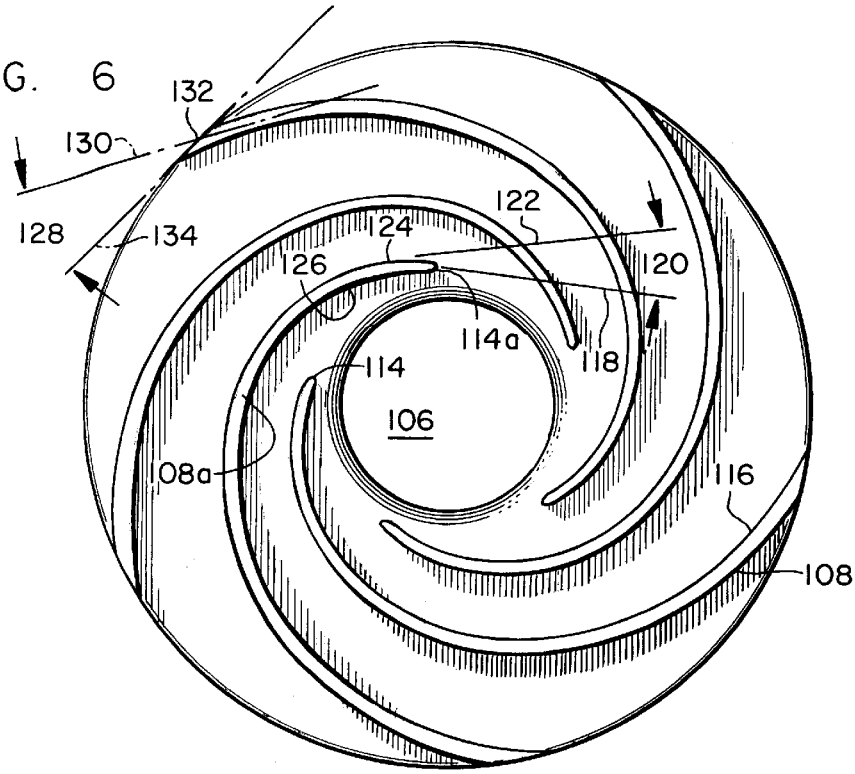
FIG. 6 is a view taken along line 5—5 of FIG. 4.

Referring now to Drawing FIGS. 4, 5 and 6, the particulars of refrigerant pump 36 and, in particular, a stand alone embodiment **36*a* of refrigerant pump 36, will be examined. Common features/components of pumps 36 and 36*a*** will be identified with common reference numerals.

The primary component of pumps 36 and **36*a* is impeller 34 which is disposed in impeller cavity 76 of volute housing 78. In the case of the previously described combined refrigerant/lubricant pump where a single drive motor is used to drive both the refrigerant and lubricant pump mechanisms and where such motor is ensconced in an oil supply tank, seal 72 seals off impeller cavity 76 from the interior of such tank. In the case of the pump 36*a* embodiment of FIGS. 4, 5 and 6, seal 72 seals off impeller cavity 76 from the ambient surroundings of housing 78**.

As is illustrated in FIG. 4, volute housing 78, in the stand alone embodiment, is comprised of first volute housing section **78*a* and second volute housing section 78*b* which cooperate to define impeller cavity 76. Volute housing 78 defines a liquid refrigerant inlet 102 and a liquid refrigerant outlet 104. As installed, appropriate piping (not shown) will deliver liquid refrigerant both to and from housing 78 through inlet 102 and outlet 104** respectively.

In the embodiment of FIGS. 4, 5 and 6, refrigerant pump **36*a* is driven in a generic fashion by a motor M which may or may not drive another pumping mechanism and which may or may not be electrically driven. Impeller 34 is driven through shaft 100 by motor M and is identical to the impeller 34** employed in the dual-purpose pump of the preferred embodiment.

In order to minimize and/or prevent the flashing of liquid refrigerant pumped by pump 36 of the preferred embodiment and pump **36*a* of the stand alone embodiment to gas and the degradation of pump performance associated therewith, impeller 34 is of a unique design. In that regard, impeller 34** can be characterized as an impeller with (1) a relatively large inlet diameter, (2) vanes that are disposed to interact with the pumped refrigerant only after that refrigerant has exited the axial flow inlet area, (3) a relatively low number of vanes, each having relatively thin leading edges, (4) the angle of incidence of incoming liquid refrigerant with respect to its vanes minimized and (5) a vane exit angle selected to provide essentially flat pressure/flow characteristics across a relatively wide range thereof.

These parameters/characteristics arise from and are driven by the difficulty associated with pumping a saturated fluid, such as low pressure refrigerant in its saturated liquid form. If the pressure of such a saturated liquid is depressed, such as can happen when such a liquid is drawn into a pump, a change state of the fluid or a portion of it from liquid to gas can occur. Depending upon the degree of pressure depression and the shape of the phase diagram which is characteristic of the fluid being pumped, the amount of the liquid that will flash to gas (as a percentage of its mass) will vary as will the resulting volume of gas that is generated. The creation of too much gas will cause the pump to lose performance with respect to the head and/or flow rate it produces which can be catastrophic in certain pump applications. Because of its characteristics and for those reasons, the low pressure refrigerant referred to as R123, particularly as it is used in a critical refrigeration chiller application such as motor cooling, is a difficult and demanding liquid to pump.

In the case of the pump of the present invention, a centrifugal as opposed to a positive displacement design was selected for the reason that pumps of the centrifugal design do not have parts that are in direct contact, which makes them more reliable, and for the reason that calculations relating to fluid flow in centrifugal pumps are more well known and predictable than is the case with positive displacement pumps. The criteria for designing the pump of the present invention, with respect to its application in pumping a low pressure liquid refrigerant in a refrigeration chiller for purposes of cooling the chiller's drive motor, are varied and many. All, however, are selected in view of maintaining a relatively slow flow rate in the liquid refrigerant as it travels from its source, to and through the pump and to the location of its application/use. By keeping the flow rate slow, pressure drop in the pumped fluid and the flashing/pump cavitation that results therefrom is minimized as is the reduction in motor cooling effectiveness that occurs when refrigerant gas as opposed to liquid is delivered into contact with the compressor drive motor.

In that regard and with respect to the design of impeller 34, the pressure drop associated with the flow of liquid refrigerant into and through its inlet portion 106 was minimized so that only a relatively small fluid head above the inlet is required to ensure good pump operation. In that regard, the pressure in the liquid refrigerant at the location of a pump inlet, as would be the case with any liquid, is partially dependent on the height above the pump inlet the source of the pumped liquid refrigerant is. The greater the height above the pump inlet the source of the pumped liquid is, the greater will be the pressure of the liquid at the pump inlet and the less will be the effect of any pressure drop that might occur in this region.

In the refrigeration chiller application for which the pump of the present invention is designed, the source of the liquid refrigerant to be pumped will not be significantly above floor level and the refrigerant pump cannot be mounted below the base of the chiller which is typically at floor level. As such, the head to which the refrigerant is exposed at the pump inlet location cannot be counted upon to be significant in such applications and minimizing pressure drop at the pump inlet location is therefore critical. Other criteria driving the design of the refrigerant pump of the present invention in both its combined and stand alone embodiments are that it (1) must be suitable for use in both 60 Hertz and 50 Hertz applications, (2) deliver adequate pressure and flow over the range of liquid refrigerant temperatures and pressures characteristic of the refrigeration chillers in which it is employed and (3) perform such that one pump design functions over the range of motor cooling flow rates required with respect to a family of such chillers of significantly differing refrigeration capacities.

With the above criteria in mind, impeller 34 is designed so that its inlet portion 106 is of relatively large diameter. The relatively large inlet diameter prevents the acceleration of the refrigerant being pumped to any significant extent. That, in turn, prevents the occurrence of the pressure drop that accompanies and is inherent in fluid acceleration.

Further, vanes 108 of impeller 34 do not start until the fluid being pumped has, for the most part, transitioned from the axial direction, which is characteristic of flow into and through inlet area 106 and is indicated at 110 in the drawings, to generally radial flow, indicated at 112 in the drawings, downstream of the impeller inlet area. By not starting the vanes in inlet portion 106 of the impeller where flow is in the axial direction, the refrigerant pumped by impeller 34 and the pump of the present invention is permitted to start rotating and to build up pressure before reaching the leading edges 114 of the vanes. Still further, vane height decreases from the leading edges 114 of the vanes to the trailing edge portions 116 thereof. This design feature likewise acts to reduce pressure drop at and prior to the entry of the pumped liquid into the vaned portion of the impeller.

As a result of these design characteristics, the rate of fluid flow is maintained relatively slow in the inlet portion 106 of the impeller, the effect of the fluid's entry into the vaned portion of the impeller, which includes some acceleration and pressure drop, is mitigated and little or no refrigeration flashing/pump cavitation occurs. These characteristics and design criteria, which focus, once again, on maintaining the pumped fluid in the liquid state rather than on the efficiency of the pump, are atypical of most centrifugal pumps the designs of which are driven by a desire to achieve high pump efficiency and flow rates.

Also mitigating the effects on the fluid's entry into the vaned portion of the impeller are the use of a low number of vanes 108 and the use of vanes having thin leading edges 114. In the preferred embodiment, impeller 34 has only five vanes. The thickness of the leading edges thereof is less than 0.1 inches and are preferably on the order of 0.050 inches. The use of five vanes having thin leading edges together with the other design characteristics identified above has been found to be optimum for the low pressure liquid refrigerant pumping application while the performance of a pump having eight or more vanes with somewhat thicker leading edges proved unsatisfactory. The thickness of the vanes is permitted to increase between the leading and trailing edge portions thereof.

Also with respect to the entry of the fluid into the vaned portion of impeller 34, the vanes are designed to minimize the angle of incidence of the fluid with respect to the leading edges 114 of the vanes. By minimizing the angle of incidence, fluid separation from the vane surfaces and the pressure drop occasioned thereby is minimized.

Referring to FIG. 6 in that regard, line 118 indicates a line of 0° incidence with the leading edge 114*a* of vane 108*a*. The angle of incidence 120 at which the pumped fluid initially interacts with vanes 108 will preferably be from 0° (parallel to line 118) to 10° in the direction of line 122 on the suction side 124 of the vanes. If the angle of incidence on the suction sides 124 of the vanes is greater than 10°, cavitation has been found to occur and pump performance severely degrades. If the angle of incidence of the incoming liquid is on the pressure side 126 of the vanes, significant pressure drop and turbulence occurs and the pump will likewise not perform. With respect to all of these characteristics, their purpose/use, once again, is driven by the need to maintain a low flow rate in the saturated liquid refrigerant being pumped. So long as the flow rate of the liquid is sufficiently low, neither significant pressure drop, nor refrigerant flashing or pump cavitation will occur to any great extent.

Finally, the vane exit angle 128 in impeller 34, which can be characterized as the angle between the centerline 130 of a vane 108 at the location of its trailing edge face 132 and a tangent 134 thereto, is acute and is selected so as to provide relatively flat pressure/flow characteristics which allows the pump to be used across the entire tonnage range of a family of refrigeration chillers. Achievement of that objective is demonstrated by FIG. 7 which is a graph of flow rate delivered versus head developed for refrigerant pumps of the design of the present invention as applied in chillers of varying capacity.

Figure 7:
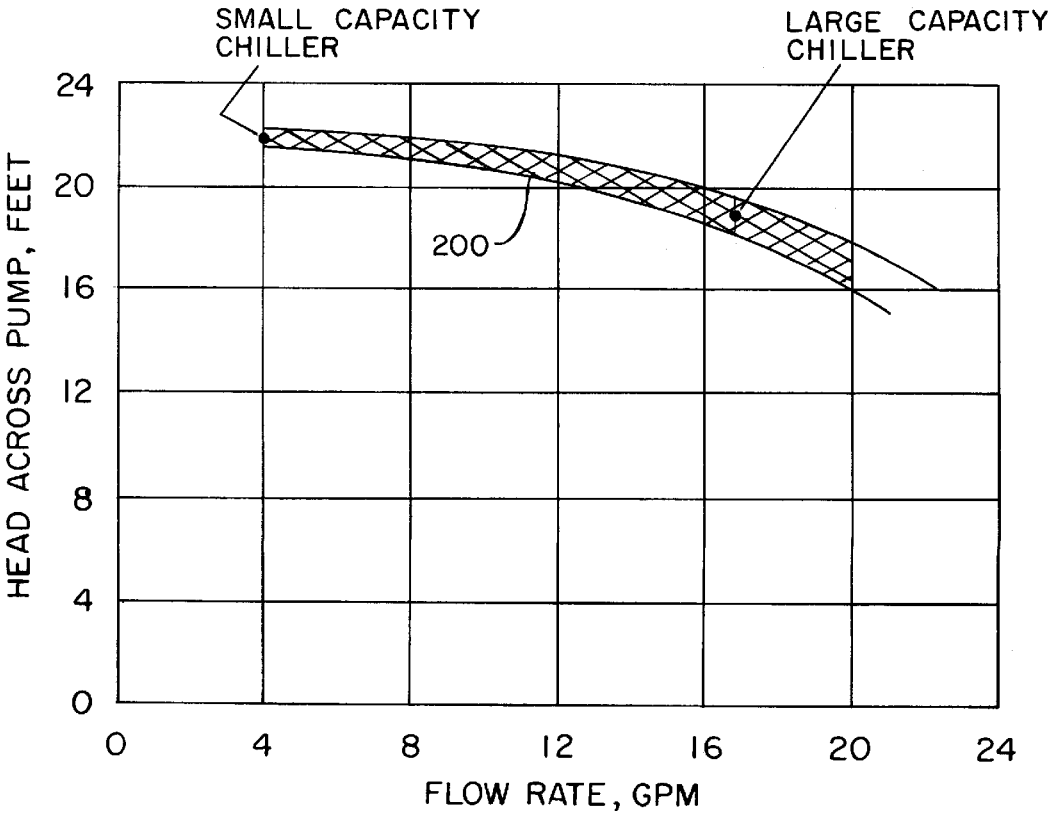
FIG. 7 is a chart of the performance characteristics of the refrigerant pump of the present invention comparing flow rates and head for a pump driven by 60 Hertz power.

As is illustrated by the cross hatched region 200 in the graph of FIG. 7, relatively low and slow liquid refrigerant flow rates, between 4 gallons per minute when the pump is applied in a refrigeration chiller of small capacity, and 17 gallons per minute, when the pump is applied in large capacity chillers, are produced by the pump. The pump has, in fact, been demonstrated to be capable of successfully pumping liquid refrigerant at rates of up to 20 gallons per minute.

Also achieved by the pump of the present invention, as illustrated in FIG. 7, is the development of head exceeding 16 feet, irrespective of the capacity of the chiller to which it is applied. This means that the pump is capable of vertically lifting and delivering liquid refrigerant to the location of its use for motor cooling purposes in all such chillers irrespective of capacity, since the drive motors of such chillers are all well below 16 feet above the bases thereof. The results achieved, as illustrated by cross hatched region 200, were achieved for refrigerant saturation temperatures varying from as low as 60° F. to as high as 110° F. with the height of the source of liquid refrigerant above the pump inlet being as little as nine inches.

In sum, the pump of the present invention has proven to be able to pump saturated, low pressure liquid refrigerant to heights in excess of 16 feet, from a source thereof which is as little as nine inches above the pump inlet, at refrigerant saturation temperatures varying from and between 60° F. and 110° F. and as applied in refrigeration chillers of widely varying capacities. As such, the pump of the present invention is a "one size fits all" pump which is extremely efficient and versatile from the standpoint of its performance for its intended purpose, its manufacturing cost and the cost of its application and use in a family of refrigeration chillers of widely differing capacities.

While the present invention has been described in terms of a preferred and first alternate embodiment, it will be appreciated that many modifications thereto are contemplated and fall within its scope as claimed.

What is claimed is:

1. Apparatus for pumping both refrigerant and lubricant in a refrigeration chiller comprising:

a motor;

a drive shaft driven by said motor;

a refrigerant pumping element, said refrigerant pumping element being mounted to said drive shaft; and a lubricant pumping element, said lubricant pumping element being mounted to said drive shaft.

2. The pumping apparatus according to claim 1 wherein said refrigeration chiller has a lubricant supply tank, said motor and said lubricant pumping element being disposed in said supply tank and said refrigerant pumping element being disposed external of said lubricant supply tank.

3. The pumping apparatus according to claim 2 wherein said refrigerant pumping element is a centrifugal impeller.

4. The pumping apparatus according to claim 3 wherein said refrigerant pumping element is mounted for rotation on a first end of said drive shaft and wherein said lubricant pumping element is mounted for rotation on a second end of said drive shaft, said drive shaft penetrating a wall of said lubricant supply tank.

5. The pumping apparatus according to claim 4 further comprising a housing for said refrigerant pumping impeller said housing having a refrigerant inlet and a refrigerant outlet and being mounted to said wall of said lubricant supply tank.

6. The pump according to claim 5 further comprising a housing for said lubricant pumping element, said housing for said lubricant pumping element defining a bearing housing, a first bearing being disposed in said bearing housing defined by said housing for said lubricant pumping element, said drive shaft being rotatably carried in said first bearing.

7. The pump according to claim 6 wherein said motor has a stator and a rotor and further comprising a housing for said motor, said stator being mounted in housing for said motor and said housing for said motor being mounted to said wall of said lubricant supply tank.

8. The pump according to claim 7 wherein said wall of said lubricant supply tank defines a bearing housing, a second bearing being disposed in said bearing housing defined by said wall, said motor rotor being mounted to said drive shaft for rotation therewith and said drive shaft being rotatably carried in said second bearing and said motor housing defining an aperture, lubricant in said lubricant supply tank flooding said motor housing through said aperture.

9. The pumping apparatus according to claim 8 further comprising a pump port plate, said pump port plate being mounted to said lubricant pump element housing, said pump port plate defining a passage by which lubricant is delivered to said lubricant pumping element and a passage by which lubricant is delivered therefrom.

10. A method for cooling the compressor drive motor in a refrigeration chiller and for delivering lubricant to a surface therein that requires lubrication comprising the steps of:

disposing a lubricant pumping element in the lubricant supply tank of said chiller;

connecting a drive shaft to said lubricant pumping element;

connecting a refrigerant pumping element to said drive shaft so that said lubricant pumping element and said refrigerant pumping element are driven by a common drive shaft;

driving said drive shaft with a pump motor;

providing a source of liquid refrigerant from which said refrigerant pumping element can pump;

providing a flow path for refrigerant pumped by said refrigerant pumping element to the motor by which the compressor of said chiller is driven; and providing a flow path for lubricant pumped by said lubricant pumping element to said surface that requires lubrication.

11. The method according to claim 10 comprising the further step of disposing said refrigerant pumping element outside of the lubricant supply tank of said chiller.

12. The method according to claim 11 wherein said pump motor is an electric motor and comprising the further step of immersing said motor by which said drive shaft is driven in lubricant in said lubricant supply tank.

13. The method according to claim 12 wherein said source of liquid refrigerant is the condenser of said chiller and further comprising the step of providing a flow path from said chiller condenser to said refrigerant pumping element.

14. The method according to claim 13 comprising the further step of rotatably supporting said drive shaft in a bearing disposed in a wall of the lubricant supply tank of said chiller.

* * * * *